US009516961B1

(12) United States Patent
Yambao et al.

(10) Patent No.: US 9,516,961 B1
(45) Date of Patent: Dec. 13, 2016

(54) CONTAINER WITH PERSONALIZATION SYSTEM

(71) Applicants: Alexander N. Yambao, Las Vegas, NV (US); Maria Yambao, Las Vegas, NV (US); Ashley Yambao, Las Vegas, NV (US); Allen Yambao, Las Vegas, NV (US)

(72) Inventors: Alexander N. Yambao, Las Vegas, NV (US); Maria Yambao, Las Vegas, NV (US); Ashley Yambao, Las Vegas, NV (US); Allen Yambao, Las Vegas, NV (US)

( * ) Notice: Subject to any disclaimer, the term of this patent is extended or adjusted under 35 U.S.C. 154(b) by 0 days.

(21) Appl. No.: 15/092,826

(22) Filed: Apr. 7, 2016

(51) Int. Cl.
*B65D 85/00* (2006.01)
*A47G 19/22* (2006.01)
*B65D 23/14* (2006.01)

(52) U.S. Cl.
CPC ..... *A47G 19/2227* (2013.01); *B65D 23/14* (2013.01); *B65D 2203/02* (2013.01)

(58) Field of Classification Search
CPC .. A47G 19/2227; B65D 23/14; B65D 2203/02
USPC ..... 206/459.1, 459.5; 116/306, 309, 316, 116/317; 40/310, 306, 324
See application file for complete search history.

(56) References Cited

U.S. PATENT DOCUMENTS 3,787,993 A * 1/1974 Lyon ..... F17C 13/003 116/200
4,759,139 A 7/1988 Ricks
4,877,119 A * 10/1989 Hosking ..... G01F 19/00 116/227
5,839,581 A * 11/1998 Vagedes ..... B65D 47/06 206/459.1
D434,655 S 12/2000 Haugh et al.
8,220,187 B2 7/2012 Rosen
9,433,310 B1 * 9/2016 Roig ..... A47G 19/2227
2002/0104613 A1 * 8/2002 Key ..... B65C 9/20 156/268
2004/0128877 A1 7/2004 Luedde
2004/0129712 A1 * 7/2004 Egan ..... G09F 3/10 220/592.16
2004/0205989 A1 * 10/2004 Michaels ..... G09F 3/14 40/310
2005/0138854 A1 * 6/2005 Simmons ..... G09F 3/14 40/665
2005/0235532 A1 10/2005 Eberl et al.
2006/0207132 A1 9/2006 Vaughan et al.
2006/0283059 A1 12/2006 Cope et al.
2008/0023363 A1 * 1/2008 Valadez ..... A47G 19/2227 206/459.1
2009/0015000 A1 * 1/2009 Wolfe ..... B65D 23/14 283/74
2009/0084701 A1 * 4/2009 Isserow ..... B01F 13/002 206/459.5
2009/0094870 A1 * 4/2009 Isserow ..... G09F 3/04 40/306

(Continued)

*Primary Examiner* — Jacob K Ackun
*Assistant Examiner* — Jenine Pagan
(74) *Attorney, Agent, or Firm* — Michael R. Philips

(57) ABSTRACT

The present invention provides a container including a system for personal identification. A series of bands are mounted between ridges formed circumferentially around the container. The bands have symbols printed in a color similar to the container. The bands can be rotated around the container to position selected symbols over a patch printed on the container in a contrasting color to make the selected symbol visible.

12 Claims, 2 Drawing Sheets

(56) References Cited

U.S. PATENT DOCUMENTS

| | | | | |
|---|---|---|---|---|
| 2009/0145009 | A1* | 6/2009 | Zinszer Desatoff | G09F 23/06 40/306 |
| 2009/0266735 | A1* | 10/2009 | Moore | G09F 3/0288 206/459.5 |
| 2009/0293328 | A1* | 12/2009 | Bull | G09F 3/005 40/310 |
| 2010/0236119 | A1 | 9/2010 | Pellei | |
| 2011/0100851 | A1* | 5/2011 | Figueroa | B65D 23/00 206/459.1 |
| 2011/0297573 | A1 | 12/2011 | Chen | |
| 2012/0055964 | A1* | 3/2012 | Gluck | A47G 19/2227 224/267 |
| 2013/0276339 | A1 | 10/2013 | Hernandez et al. | |
| 2015/0351566 | A1* | 12/2015 | Lara | G09F 23/08 206/459.5 |

* cited by examiner

CONTAINER WITH PERSONALIZATION SYSTEM

FIELD OF THE INVENTION

The present invention relates to the field of personalized identification of property, and more particularly to personal identification of a drinking container.

BACKGROUND OF THE INVENTION

Water has become a popular drink of choice. Water is sold in individual size bottles for the purchaser to carry during the day. These individual size water bottles, for reasons of economy, are made of plastic resin that is blow molded to a very thin wall thickness. This thin wall causes two specific problems. First, the bottle will easily collapse when squeezed or just held firmly. Second, the water becomes warm fairly quickly as the thin bottle wall is a minimal thermal barrier. In addition, these bottles in general have become a burden on the nation's landfills.

These problems have encouraged an industry that provides reusable water bottles that are typically filled from a water tap or other source and reused. A reusable water bottle is generally made with thicker plastic walls, overcoming the crushing and thermal transfer problems as well as the disposal problem. In addition, a reusable water bottle is a separate sale item which the purchaser keeps for a period of time. A reusable water bottle can also be a medium for advertising, for example bearing the name of a business such as an exercise facility. However, a need exists to identify the reusable water bottle allowing the owner to be comfortable in knowing that he or she is drinking from their own bottle.

SUMMARY OF THE INVENTION

The invention disclosed herein provides a system for the identification of a drinking bottle or similar container in order to reduce the likelihood of a person taking and drinking from a container belonging to another. The description below is directed to a bottle, but encompasses similar containers. The bottle is formed of a plastic resin or other moldable material. A series of circumferential ridges are formed on the bottle with a flat between each pair of adjacent ridges. A patch is formed on each flat, the patch being of a color that provides a contrast with the color of the bottle. The series of patches are aligned with one another in a vertical line. A band of translucent or transparent material is mounted between each pair of adjacent ridges to reside over each flat. The bands are printed with letters or other symbols in a color to blend with the bottle color, therefore contrasting with the patch color. The user of the bottle is therefore able to rotate the bands into positions to place a selected symbol over the patch, making the series of symbols visible by the contrasting patch color. The unique series of symbols enables the user to identify their bottle.

DESCRIPTION OF THE PREFERRED EMBODIMENT

Figure 1:
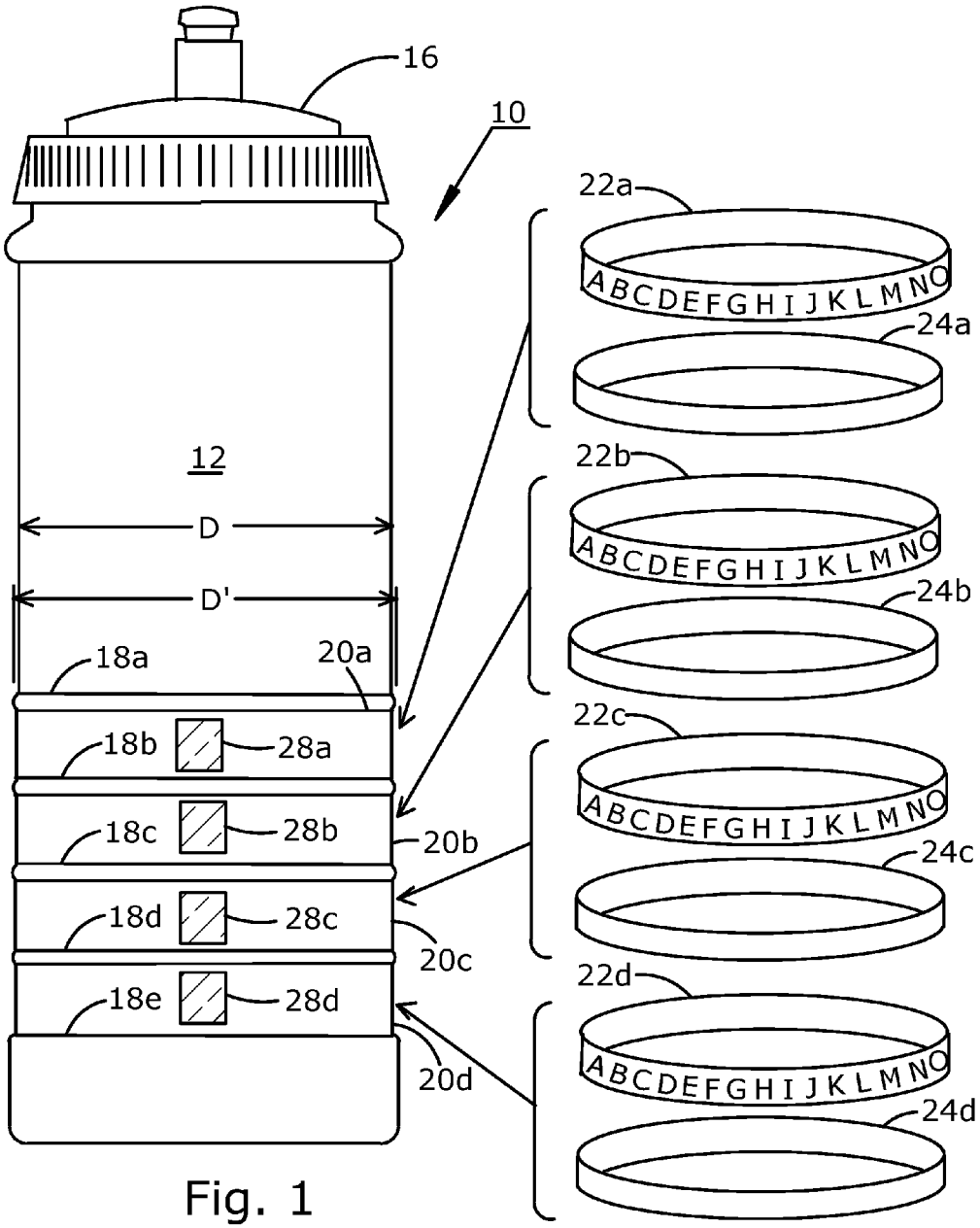
FIG. 1 is a front elevation view of a reusable water bottle with a set of identification bands in position for being assembled onto the water bottle.

Referring to FIG. 1, a bottle 10 is shown in front elevation view. Bottle 10 has a substantially cylindrical body 12 and a removable cap 16 that includes a spout. Although the drawing figure and description herein depict a plastic bottle, it is understood that the novel features of the disclosed invention are equally applicable to alternate types of containers, for example open top plastic tumblers as well as bottles or tumblers made of other materials, e.g. glass. A series of ridges 18*a*, 18*b*, 18*c*, 18*d*, and 18*e* are formed around the lower section of body 12. The ridges extend radially outward beyond the diameter D of body 12 for a ridge diameter D'. Each pair of adjacent ridges 18*a* through 18*e* are separated from one another by a flat portion 20*a*, 20*b*, 20*c*, and 20*d*, the flat portions 20*a* through 20*d* residing at diameter D of body 12. In this manner, each ridge 18*a* through 18*e* is raised relative to the diameter D of body 12. Optionally, the flats may have a smaller diameter than body 12 and the ridges have a similar diameter to body 12.

Referring further to FIG. 1, a contrast patch 28*a* is formed, e.g. printed, on flat 20*a*. If bottle 10 is a light color, for example white, contrast patch 28*a* would be a dark color, for example black. Contrast patch 28*a* may be formed by printing on flat 20*a* or formed by applying an adhesive label. A series of further contrast patches 28*b* is formed on flat 20*b*, 28*c* is formed on flat 20*c*, and 28*d* is formed on flat 20*d*. It is preferred that contrast patches 28*a* through 28*d* are positioned in vertical alignment with one another.

Continuing with FIG. 1, a series of identification bands 22*a*, 22*b*, 22*c*, and 22*d* are shown adjacent to bottle 10 in perspective view for clarity. Identification bands 22*a* through 22*d* are each printed with indicia, for example displaying alphabetic characters. The identification bands 22*a* through 22*d* are preferably formed of a translucent elastic resin and are sized to snugly fit on flats 20*a* through 20*d* between adjacent ridges. The indicia are preferably printed in an opaque color substantially matching the color of body 12, i.e. a white letter set is printed on bands to be used on a white bottle.

Referring further to FIG. 1, it is noted that whereas identification bands 22*a* through 22*d* are formed of an elastic resin, and are sized to fit snugly onto flats 20*a* through 20*d*, a considerable amount of friction will make it difficult for a user of bottle 10 to rotate identification bands 22*a* through 22*d* around bottle 10. A series of slip bands 24*a*, 24*b*, 24*c*, and 24*d* are shown adjacent to bottle 10, interspersed with identification bands 22*a* through 22*d*. Slip bands are formed of a resin having a relatively low coefficient of friction when in contact with bottle 10. Slip bands 24*a* through 24*d* are placed on bottle 10 in each respective flat 20*a* through 20*d* before placing identification bands 22*a* through 22*d* thereupon. In this way, the identification bands are permitted to be rotated relatively easily around bottle 10. An elastic resin suitable for the purpose of the present invention identification bands is silicone rubber, and a low friction resin suitable for the slip bands is polyethylene.

Figure 2:
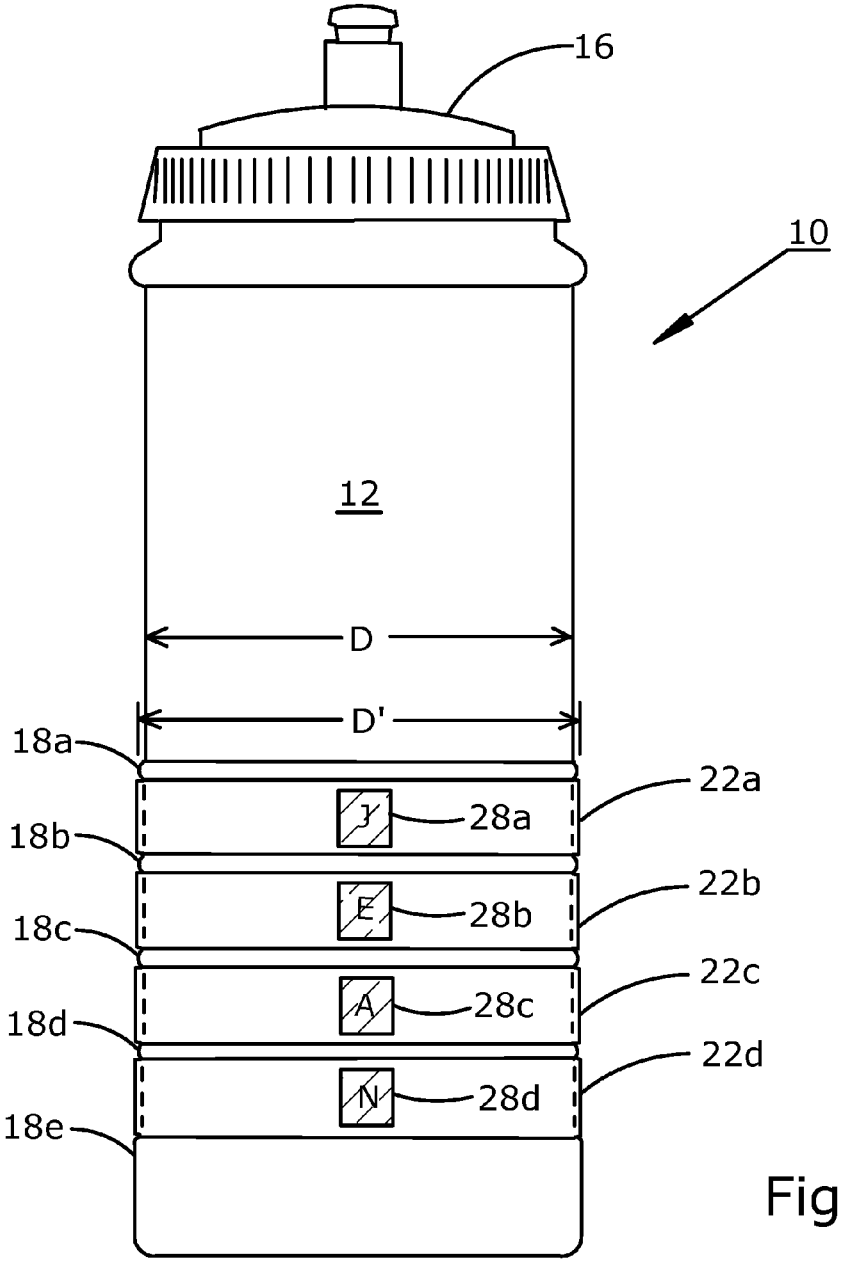
FIG. 2 depicts the reusable water bottle of FIG. 1 after the bands have been assembled on the water bottle and positioned to show an identifying name.

Referring now to FIG. 2, bottle 10 is illustrated in front elevation view with identification bands 22*a* through 22*d* mounted thereon. As shown, identification bands 22*a* through 22*d* have an outside diameter when mounted on bottle 10 that is substantially equal to diameter D' of ridges 18*a* through 18*e*. Although not visible in this view, slip bands 24*a* through 24*d* (see FIG. 1) have been mounted on bottle 10 to reside between bottle 10 and respective identification bands 22*a* through 22*d*. With identification bands

22*a* through 22*d* mounted on body 12 in flats 20*a* through 20*d* (see FIG. 1), and the printed letters matching the color of bottle 10, none of the printed letters are readable except for the single letter that resides over the respective contrast patch 28*a* through 28*d*, the contrasting color making the letter visible. The series of letters positioned at contrast patches 28*a* through 28*d* in FIG. 2 spell the name "JEAN". To spell a different name or other term, identification bands 22*a* through 22*d* are rotated and different printed letters become visible over contrast patches 28*a* through 28*d*.

While the description above discloses a preferred embodiment of the present invention, it is contemplated that numerous variations and modifications of the invention are possible and are considered to be within the scope of the claims that follow.

What is claimed is:

1. A container with personalization system, comprising:

a. a substantially cylindrical body having a plurality of spaced apart ridges, the body being of a first color;

b. a contrast patch positioned on the body between each pair of adjacent ridges;

c. an identification band sized to snugly encircle the body between adjacent ridges, the identification band printed with a series of symbols; and d. a slip band sized to encircle the body between adjacent ridges beneath the identification band.

2. The container described in claim 1, wherein the ridges are formed circumferentially around the container body.

3. The container described in claim 1, wherein the contrast patches are positioned in vertical alignment with one another.

4. The container described in claim 1, wherein the identification band is translucent.

5. The container described in claim 4, wherein the symbols are similar in color to the first color.

6. The container described in claim 4, wherein the contrast patch is of a second color, the second color contrasting with the first color.

7. The container described in claim 5, wherein the contrast patch is of a second color, the second color contrasting with the first color.

8. The container described in claim 5, wherein the identification band is elastic.

9. The container described in claim 6, wherein the slip band has a low coefficient of friction.

10. The container described in claim 1, wherein the plurality of ridges comprises five ridges with a flat between each pair of adjacent ridges.

11. The container described in claim 10, wherein an identification band is provided for each of the flats.

12. The container described in claim 10, wherein a slip band is provided for each of the flats.

* * * * *